US008413570B2

(12) United States Patent
Langner

(10) Patent No.: US 8,413,570 B2
(45) Date of Patent: Apr. 9, 2013

(54) DISRUPTER EJECTION AND RECOVERY SYSTEM AND METHOD THEREFOR

(76) Inventor: F. Richard Langner, Fountain Hills, AZ (US)

( * ) Notice: Subject to any disclaimer, the term of this patent is extended or adjusted under 35 U.S.C. 154(b) by 102 days.

(21) Appl. No.: 13/118,233

(22) Filed: May 27, 2011

(65) Prior Publication Data

US 2012/0180644 A1 Jul. 19, 2012

Related U.S. Application Data

(60) Provisional application No. 61/396,526, filed on Jun. 1, 2010.

(51) Int. Cl.
*F41A 25/00* (2006.01)
*F42D 5/04* (2006.01)

(52) U.S. Cl.
USPC ..... 89/42.01

(58) Field of Classification Search ..... 89/2.01–44.024
See application file for complete search history.

(56) References Cited

U.S. PATENT DOCUMENTS

| | | | | |
|---|---|---|---|---|
| 2,785,632 | A * | 3/1957 | Clauser et al. | 102/340 |
| 3,128,670 | A * | 4/1964 | Blacker | 89/1.702 |
| 4,932,308 | A | 6/1990 | Arene | |
| 6,295,911 | B1 * | 10/2001 | Woodall et al. | 89/1.13 |
| 6,578,464 | B2 | 6/2003 | Ebersole, Jr. | |
| 6,889,594 | B2 | 5/2005 | Ebersole, Jr. | |
| 8,307,941 | B2 * | 11/2012 | Luchini et al. | 181/106 |

FOREIGN PATENT DOCUMENTS

| | | |
|---|---|---|
| GB | 1000272 | 8/1965 |
| GB | 1079098 | 8/1967 |
| WO | WO 89/04451 | 5/1989 |

* cited by examiner

*Primary Examiner* — Michael David
(74) *Attorney, Agent, or Firm* — Letham Law Firm LLC; Lawrence Letham

(57) ABSTRACT

An ejection and recovery system for a disrupter barrel has a parachute. A housing having a channel formed there through is provided wherein the disrupter barrel is positioned in the channel. A tube is coupled to the housing for storing the parachute. A lanyard is coupled to the parachute and to the disrupter barrel.

19 Claims, 3 Drawing Sheets

DISRUPTER EJECTION AND RECOVERY SYSTEM AND METHOD THEREFOR

RELATED APPLICATIONS

This invention claims priority, under 35 U.S.C. §120, to the U.S. Provisional Patent Application No. 61/396,526 to F. Richard Langner filed on 1 Jun. 2010, which application is incorporated by reference herein.

FIELD OF THE INVENTION

The present invention relates to percussion actuated non-electric (PAN) disrupters or dearmers, and more specifically, to a disrupter ejection and recovery system for use with light weight disrupter barrels which are used for disabling and destroying IEDs.

BACKGROUND OF THE INVENTION

Percussion actuated non-electric (PAN) disrupters or dearmers are often used by military personnel, bomb squads, and other emergency service personnel in the destruction and disablement of improvised explosive devices (IEDs) and other bombs and/or ordnance. A typical PAN disrupter comprises a heavy duty 12-gauge shotgun barrel which can be operated remotely through the use of a robot, for example, in order to facilitate firing of the device from a safe distance. The PAN disrupter is often engaged electrically or by a shock tube. Such a PAN disrupter uses specially designed 12-gauge shotgun ammunition in conjunction with various sighting methods which predominantly use a laser sight.

Typically, compact disrupter barrels, used for destroying IEDs, are unable to absorb the recoil created by the high energy cartridges used for this purpose. The energy generated causes the disrupter, if not restrained, to travel in the opposite direction at a high velocity and for a long distance. In one test, a disrupter traveled approximately 70 yards. Obviously, this reaction is undesirable for safety reasons, collateral damage or surrounding objects and for the loss of the disrupter. In addition, the recoil may not allow the disrupter to be mounted to a light weight robot since the force generated by the recoil may cause significant damage to the robot when fired.

Therefore, a need exists to provide a device and method to overcome the above problems of the prior art.

SUMMARY

In accordance with one embodiment, an ejection and recovery system for a disrupter barrel is disclosed. The ejection and recovery system has a parachute. A housing having a channel formed there through is provided wherein the disrupter barrel is positioned in the channel. A tube is coupled to the housing for storing the parachute. A lanyard is coupled to the parachute and to the disrupter barrel In accordance with another embodiment of the present invention, an ejection and recovery system for a disrupter barrel is disclosed. The ejection and recovery system has a parachute. A lanyard is coupled to the parachute and to the disrupter barrel.

The features, functions, and advantages can be achieved independently in various embodiments of the disclosure or may be combined in yet other embodiments.

BRIEF DESCRIPTION OF THE DRAWINGS

Embodiments of the disclosure will become more fully understood from the detailed description and the accompanying drawings, wherein.

Common reference numerals are used throughout the drawings and detailed description to indicate like elements.

DETAILED DESCRIPTION

Figure 1:
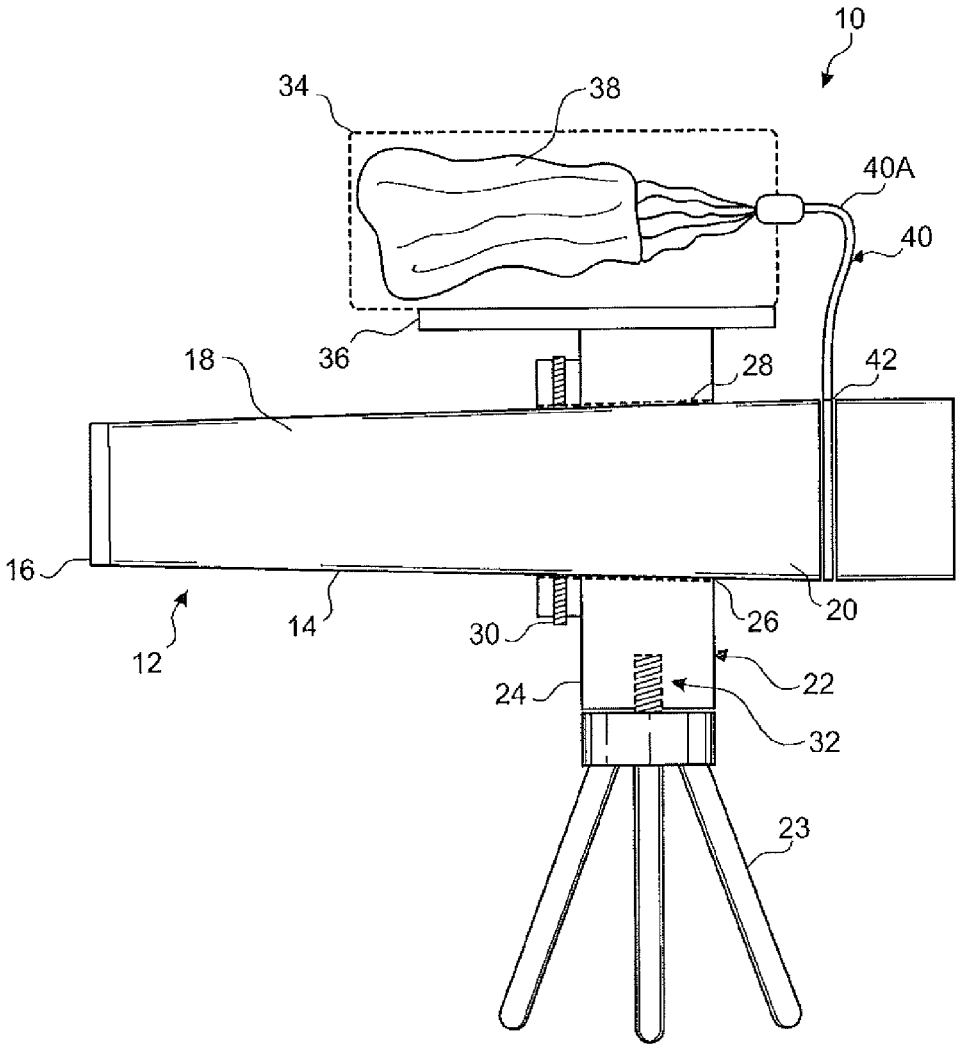
FIG. 1 is a side view of the disrupter ejection and recovery system consistent with an embodiment of the present invention.
Figure 2A:
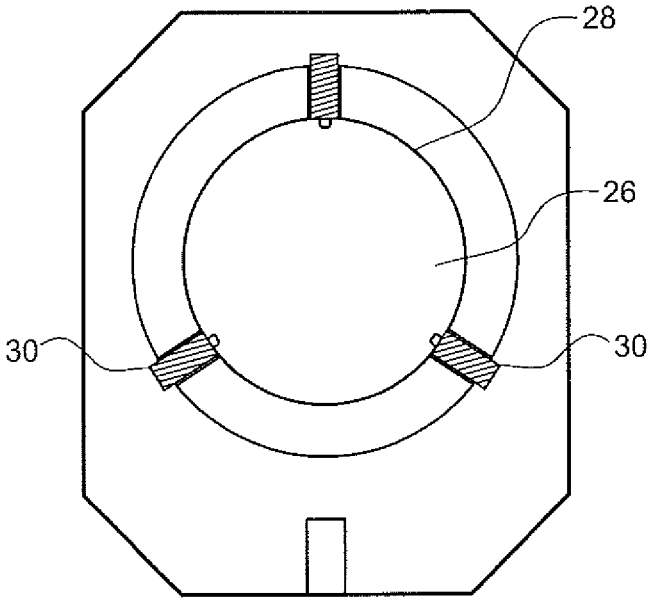
FIG. 2A is a front view of the disrupter barrel mount housing used in the system of FIG. 1.
Figure 2B:
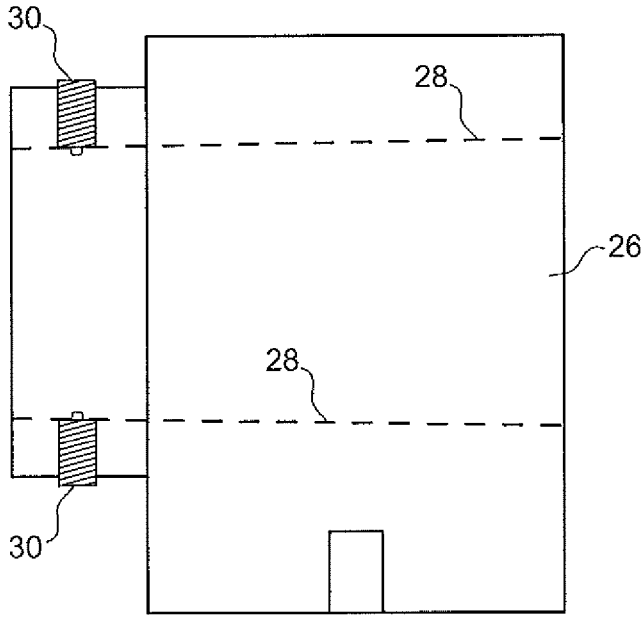
FIG. 2B is a side view of the disrupter barrel mount housing used in the system of FIG. 1.

Referring first to FIGS. 1-2, disrupter ejection and recovery system 10 (hereinafter system 10) is shown. The system 10 may have a disrupter barrel 12. The disrupter barrel 12 may be comprised of a barrel section 14 having a muzzle end 16, a bore 18, and a chamber 20. In accordance with one embodiment, the barrel section 14 may be a heavy-duty 12-gauge shotgun barrel. The barrel section 14 may be formed of a carbon fiber wrapped titanium barrel. The above are given as examples and should not be seen in a limiting manner.

Figure 3:
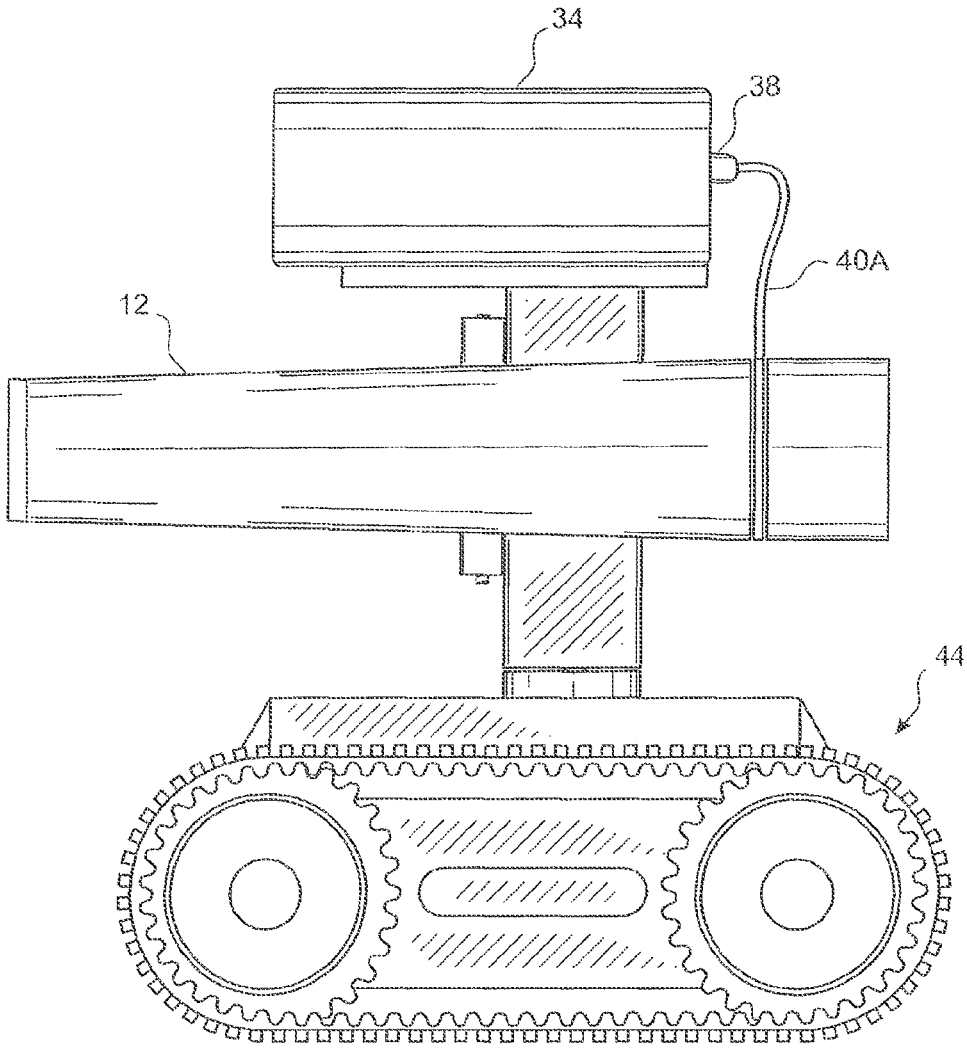
FIG. 3 is a side view of the disrupter ejection and recovery system mounted on a robot.

A barrel mounting device 22 may be secured to the barrel section 14. The barrel mounting device 22 may be used to secure the disrupter barrel 12 to a tripod 23 as shown in FIG. 1 or to a robot device 44 as shown in FIG. 3. The barrel mounting device 22 may have a housing 24. A channel 26 may be formed through the housing 24. The channel 26 may generally be a horizontal channel formed through the housing 24. The barrel section 14 may be inserted through the channel 26. The barrel section 14 may be inserted through the channel 26. The channel 26 may have a coating layer 28 applied to an interior surface of the channel 26. The coating layer 28 may be a non-stick coating such as polytetrafluoroethylene (PTFE) more commonly known as Teflon®.

One or more securing devices 30 may be used to help hold the barrel section 14 within the housing 24 when desired. The securing devices 30 may be plunger mechanisms or the like. In general, the securing devices 30 may be adjustable tension devices. The securing devices 30 would typically be required when the system 10 is mounted on a robot 44 to ensure that the barrel section 14 does not loosen during travel to the target. The slight tension, used to retain the barrel section 14, does not affect the ejection of the barrel section 14.

A coupling mechanism 32 may be formed in the housing 24. The coupling mechanism 32 may be used to secure the system 10 to the tripod 23 as shown if FIG. 1 or to the robot device 44 as shown in FIG. 3. In general, the coupling mechanism 32 may be some type of threaded channel or the like.

A tube 34 may be coupled to the housing 24. In the embodiment shown in FIG. 1, a mounting rail 36 may be used to attach the tube 34 to the housing 24. The mounting rail 36 may be a standardized mounting platform such as the Picatinny Rail Accessory Mount or the like.

The tube 34 may be used to house a parachute 38. The parachute 38 may be coupled to the barrel section 14 in order to create a drag to limit the travel of the barrel section 14. A connection device 40 may be used to secure the parachute 38 to the barrel section 14. In general, the connection device 40 may be coupled to the parachute 38 and to a rear section of the barrel section 14 such as the breech area of the barrel section 14.

In the embodiment shown in FIG. 1, a groove 42 may be formed in the barrel section 14. The groove 42 may be formed in a rear section of the barrel section 14. The connection device 40 may be a lanyard 40A or the like. One end of the lanyard 40A may be secured within the groove 42. A second end of the lanyard 40A may be secured to the parachute 38. The groove 42 may be formed in the rear section of the barrel section 14 to insure that the lanyard 40A clears the barrel mounting device 22 as well as the tripod 24 or robot device 44 to which the disrupter barrel 12 is coupled.

In operation, the disrupter barrel 12 may be operated according to standard protocol, which may generally include being operated electrically or by a shock tube in order to permit firing of the device from a safe distance. The parachute 38 may be pulled out of the tube 34 when the disrupter barrel 12 is fired and ejected from the housing 24. The parachute 38 will begin to open as soon as it has been pulled clear of the housing 24 and will contain the travel of the disrupter barrel 12 within approximately 10 yards.

While embodiments of the disclosure have been described in terms of various specific embodiments, those skilled in the art will recognize that the embodiments of the disclosure can be practiced with modifications within the spirit and scope of the claims.

What is claimed is:

1. An ejection and recovery system for a provided disrupter barrel, the system comprising:

a parachute;

a housing having a channel formed there through, the disrupter barrel positioned in the channel;

a tube coupled to the housing for storing the parachute; and a lanyard coupled to the parachute and to the disrupter barrel.

2. An ejection and recovery system for a disrupter barrel in accordance with claim 1, further comprising a groove formed around a rear section of the disrupter barrel to secure the lanyard to the disrupter barrel.

3. An ejection and recovery system for a disrupter barrel in accordance with claim 1, further comprising a non-stick coating applied on an interior surface of the channel.

4. An ejection and recovery system for a disrupter barrel in accordance with claim 1, further comprising a coating of PTFE applied on an interior surface of the channel.

5. An ejection and recovery system for a disrupter barrel in accordance with claim 1, further comprising attachment devices to secure the disrupter barrel positioned in the channel.

6. An ejection and recovery system for a disrupter barrel in accordance with claim 5, wherein the attachment devices comprise adjustable tension devices.

7. An ejection and recovery system for a disrupter barrel in accordance with claim 1, further comprising a mounting device formed on a bottom section of the housing for mounting the housing on a support stand.

8. An ejection and recovery system for a disrupter barrel in accordance with claim 1, further comprising a rail mount attached to the housing for securing the tube to the housing.

9. An ejection and recovery system for a provided disrupter barrel, the system comprising:

a parachute;

a housing having a channel formed there through, the disrupter barrel positioned in the channel;

a non-stick coating applied on an interior surface of the channel;

a rail mount attached to the housing;

a tube coupled to the rail mount, the tube for holding the parachute; and an attachment device coupled to the parachute and to the disrupter barrel.

10. An ejection and recovery system for a disrupter barrel in accordance with claim 9, wherein the attachment device comprises a lanyard.

11. An ejection and recovery system for a disrupter barrel in accordance with claim 10, further comprising a groove formed around a rear section of the disrupter barrel to secure the lanyard to the disrupter barrel.

12. An ejection and recovery system for a disrupter barrel in accordance with claim 9, wherein the non-stick coating comprises a coating of PTFE applied on the interior surface of the channel.

13. An ejection and recovery system for a disrupter barrel in accordance with claim 9, further comprising securing devices to secure the disrupter barrel positioned in the channel.

14. An ejection and recovery system for a disrupter barrel in accordance with claim 13, wherein the securing devices comprise adjustable tension devices.

15. An ejection and recovery system for a disrupter barrel in accordance with claim 9, further comprising a mounting device formed on a bottom section of the housing for mounting the housing on a support stand.

16. A system for holding a provided disrupter prior to firing the disrupter, the disrupter includes a barrel, the system comprising:

a housing having a channel through a first side and a second side of the housing, the channel open at the first side and at the second side of the housing, the channel having an axis along a length of the channel from the first side to the second side, the barrel for positioning in the channel, the barrel for extending beyond the first side and the second side of the housing along the axis of the channel;

at least one securing device positioned at least partially in the channel, the at least one securing device for holding the barrel in the channel prior to firing the disrupter;

an aerodynamic brake for limiting travel of the barrel after firing the disrupter, the aerodynamic braking having a stowed position and a deployed position, the aerodynamic brake in the stowed position prior to firing the disrupter; and a lanyard, the lanyard coupled to the aerodynamic brake and to the barrel, the lanyard for moving the aerodynamic brake from the stowed position to the deployed position responsive to movement of the barrel out of the channel along the axis after firing the disrupter.

17. The system of claim 16 wherein:

the at least one securing device comprises two or more securing devices;

the two or more securing devices are distributed around the channel.

18. The system of claim 16 further comprising a tube coupled to the housing, the tube for holding the aerodynamic brake while in the stowed position.

19. The system of claim 16 wherein the aerodynamic brake comprises a parachute.

* * * * *